US005687625A

United States Patent [19]

Galan et al.

[11] Patent Number: 5,687,625

[45] Date of Patent: Nov. 18, 1997

[54] PILOT DEVICE FOR A SUSPENDED KNIFE OF A CUTTING MACHINE FOR CUTTING SHEET MATERIAL

[75] Inventors: Mario Andrada Galan; Juan Carlos Cristo; Bernardo Alcantara Perez, all of Madrid, Spain

[73] Assignee: Investronica, S.A., Madrid, Spain

[21] Appl. No.: 416,951

[22] Filed: Apr. 5, 1995

[30] Foreign Application Priority Data

Apr. 26, 1994 [EP] European Pat. Off. ..... 94106511.2

[51] Int. Cl.[6] ..... D06H 7/00; B26D 5/00

[52] U.S. Cl. ..... 83/74; 83/427; 83/635; 83/747; 83/823; 83/941

[58] Field of Search ..... 83/72, 74, 747, 83/758, 759, 823, 936, 939, 940, 941, 427, 428, 433, 635, 647, 697, 767, 829

[56] References Cited

U.S. PATENT DOCUMENTS

| | | | |
|---|---|---|---|
| 1,940,483 | 12/1933 | Bangser | 30/275 |
| 1,975,314 | 10/1934 | Cross | 83/747 |
| 2,792,033 | 5/1957 | Bradley | 83/747 |
| 3,511,124 | 5/1970 | Bruns | 83/427 X |
| 3,589,222 | 6/1971 | Sederberg | 83/427 X |
| 3,747,454 | 7/1973 | Gerber | 83/941 X |
| 4,091,701 | 5/1978 | Pearl | 83/747 |
| 4,133,235 | 1/1979 | Gerber | 83/74 |
| 4,140,037 | 2/1979 | Gerber | 83/941 X |
| 4,261,285 | 4/1981 | Pearl | 83/941 X |
| 4,653,362 | 3/1987 | Gerber | 83/941 X |
| 5,040,442 | 8/1991 | Nasu | 83/939 X |

*Primary Examiner*—Rinaldi I. Rada
*Assistant Examiner*—Clark F. Dexter
*Attorney, Agent, or Firm*—McAulay Fisher Nissen Goldberg & Kiel, LLP

[57] ABSTRACT

An automatically controlled cutting machine for cutting multiple layers of fabric sheet material spread out on a cutting table, the cutting machine including a cutting tool which is rotatable about a Z-axis and which includes a cutting knife mounted on a cutting head and a guiding device for guiding the cutting knife. One end of the knife is mounted in the cutting head so as to be freely rotatable around the Z-axis. The guiding device is arranged adjacent to the remaining free end of the knife and comprises a socket rigidly connected to the cutting head, and a support which is freely and rotatably mounted in the socket around a vertical axis located in front and adjacent to the cutting edge of the knife, and parallel and spaced a predetermined distance from the Z-axis. The support has a slot surrounding the flanks of the knife. The slot is eccentrically positioned relative to the vertical axis and extends to the trailing edge of the knife, and the support comprises a sensor for detecting the instantaneous rotation angle and/or its direction of rotation relative to the socket for providing correcting signals for controlling the movement of the knife about the Z-axis to regulate the cutting of the material by the knife along the predetermined cutting path in response to the detected rotation angle.

6 Claims, 5 Drawing Sheets

PILOT DEVICE FOR A SUSPENDED KNIFE OF A CUTTING MACHINE FOR CUTTING SHEET MATERIAL

BACKGROUND OF THE INVENTION a) Field of the Invention

The invention relates to a pilot device for a suspended cutting knife of a cutting head of an automatically controlled cutting machine for cutting fabric sheet material spread out on a cutting table in multiple layers, which cutting head is controlled according to a three-dimensional coordinate system by means for moving the cutting head along the X- and Y-axis and pivoting about the Z-axis for moving the knife tangently along a predetermined cutting path during cutting of the material. The cutting knife is mounted so as to be reciprocally movable along the Z-axis. The cutting head further comprises guiding means for guiding the unsuspended part of the cutting knife in the cutting head and a pressure foot rigidly connected to the pivotable cutting head.

b) Description of the Related Art

Automatically closed loop controlled cutting machines for cutting sheet material as fabrics for garments spread out on the cutting table in multiple layers being held onto the cutting table by atmospheric pressure are well known.

One of the problems of such cutting machines is that without corrective measures the knife will track a cutting path in the upper ply of the layup slightly different from the cutting path in the lower ply so that the pattern pieces from the respective plies will have slightly different shapes. Therefore the height of the staple of layers to be cut is limited by the knife bending stiffness for a desired cutting quality.

Known means for compensating for defects depending on bending flexure of the knife of an automatic cutting machine comprises sensors for sensing the lateral forces acting on the flanks of the knife during cutting. These signals are transferred and applied to a computer or processor which provides correcting signals representing an additional angle or correction angles being superimposed to the orientation of the preprogrammed cutting path of the knife around the Z-axis with respect to its path; see U.S. Pat. No. 4,133,235.

According to GB-2 094 031, digital sensors are used for detecting the bending of the knife and providing signals indicating the presence of flexure and its direction. By feed-back knife position to a servomechanism, the required correction is computed in conjunction with these signals.

According to both known methods, the required correction of the knife angle has to be computed in conjunction with lateral force signals and information concerning the properties of the material to be cut in order to minimize defects depending on knife flexure.

Therefore such methods require that lateral forces acting on the knife are correctly measured and transformed into correcting signals to modify the preprogrammed orientation of the knife around its longitudinal or Z-axis and require further a relatively great expenditure in sensors, transducers, actuator and in data logger feedback gauging systems which are very complex and thus quite expensive and are further difficult to handle.

According to experience, loads acting on the knife during a cutting operation are of different types; one of these are lateral loads effecting knife bending. These lateral loads acting onto the flanks of the knife are caused by the pressure of the fabric to be cut during interaction of the cutting knife and sheet material, which generates friction loads in the feeding direction of the moving knife also. The pressure of the fabric to be cut can be different at both sides of the knife due to different reasons, such as the anisotropy of the fabrics or the proximity of a previous cut or the fabric border at one side of the knife.

The relations between lateral pressure and knife bending without evaluating other dependencies are generally indicated in FIGS. 2 and 3. Under the adoption that the pressure on a point of the knife is proportional to the compression of the fabric at this point, the following correlations are applicable.

FIG. 2 shows a sectional view on a staple of layers whereby line "t" is the theoretic path which is the path followed by the knife without bending whereas line "r" is the actual path in the section due to knife bending. Deformation in this section is "d", thus the pressure can be expressed by $$p=K\cdot y \tag{1}$$

"K" being a constant that, in general, can be different at each side of the knife due to the anisotropy or the proximity to a previous cut line, as mentioned above.

FIG. 3 shows the assumption that $$p'=K'\cdot y>p=K\cdot y \tag{2}$$

If the knife could pivot in relation to its path around an axis near its leading edge, the pressure appearing at each flank of the knife will change according to the distances "y" of every point to the cut line as shown in FIG. 3. The rotation about this axis in front of the knife would tend to balance the lateral loads, which leads to a decreasing or avoiding of the bending on the knife and the deformation "d".

OBJECTS AND SUMMARY OF THE INVENTION

Therefore a general object of the present invention is to provide a new device for minimizing the defects depending on bending of a cutting knife of a cutting machine while being in cutting position along a predetermined cutting path without measuring lateral forces acting on the flanks of the knife.

On the basis of the foregoing criteria, the general object of the invention is accomplished by a pilot device having the suspended end of the knife mounted in the cutting head freely rotatable about the Z-axis, that the guiding means arranged adjacent to the free end of the knife comprises a socket rigidly connected to the cutting head having a support being freely rotatably mounted in the socket about a vertical axis located in front and adjacent to the cutting edge of the cutting knife and parallel, at a predetermined distance, to the Z-axis of the coordinate system. The support has a slot surrounding the flanks of the knife, which slot is eccentrically positioned relative to the vertical axis and extends to the trailing edge of the knife and comprises sensor means for detecting the instantaneous rotation angle and/or its direction of the support relative to the socket and providing correcting signals for controlling the movement of the knife about the Z-axis to regulate the cutting of the material by the knife along the predetermined cutting path in response to the detected rotation angle.

Another object of the invention is to specify a structure for the guiding means which is reliable in operation, easy to manufacture and efficient in service.

This object is accomplished in that the support is freely rotatably mounted in a socket about an axis parallel to the Z-axis whereby the socket is rigidly connected to the shaft and the shaft is pivotable about the Z-axis and the shaft houses the cutting knife's reciprocally movable suspension mount, whereby the support is provided in the area of a pressure foot.

This object is further accomplished in that the output of the sensor means is transmitted to a discriminator which is followed by a processing stage for transforming the sensor signals into control signals for the controller of the cutting machine whereby the sensor means are digital or analog sensor means arranged on the socket symmetrically relative to a center line rectangular to the Z-axis and the vertical axis.

This object is further accomplished in that the sensor means comprise two microswitches whereby each microswitch represents one direction of the motion of the support relative to the socket.

The invention will now be described by way of example and with reference to the accompanying drawings.

DESCRIPTION OF THE PREFERRED EMBODIMENTS

Figure 1:
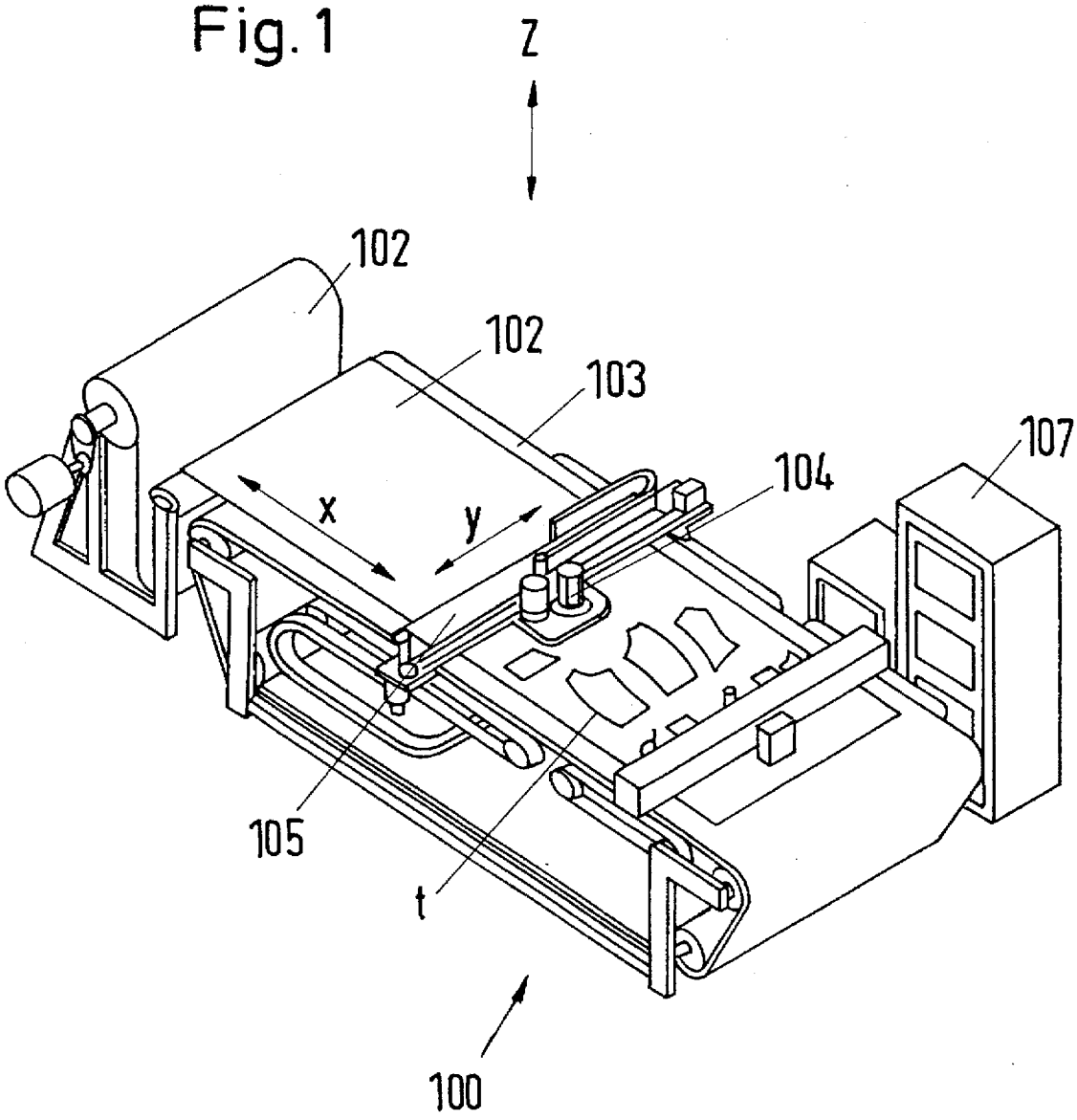
FIG. 1 shows a schematical perspective view of an automatic controlled cutting machine for cutting multiple layered sheet material held by atmospheric pressure.
Figure 2:
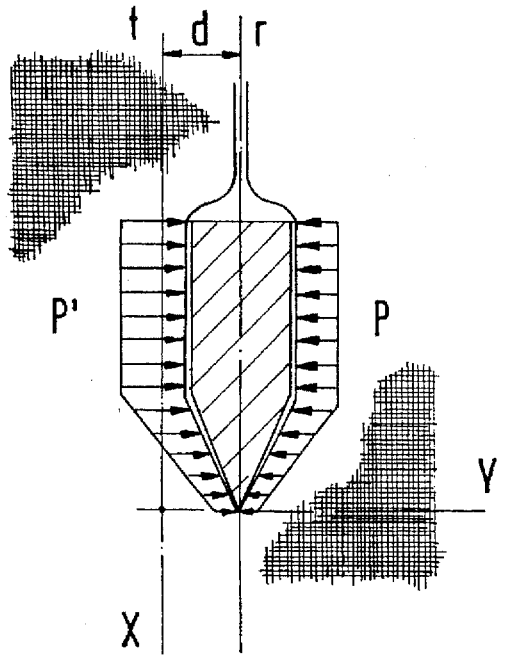
FIG. 2 shows an orthogonal section through the cutting knife and the unequal load distribution acting on the flanks of the knife during cutting.

Referring to FIG. 1, the present invention relates to an automatically controlled cutting machine 100, in which a staple 102 of layers of fabric material to be cut is fed from a suitable supply means at one end of a cutting table and is passed over a cutting table 103. On the surface of the cutting table 103, these sheets of fabrics are spread for cutting by a cutting tool reciprocally movably mounted in a cutting head 104 which is mounted on an X-Y-carriage 105 for moving over the cutting table along X-Y-coordinates. The cutting tool is a suspended blade or knife and reciprocatable along its longitudinal axis pivotably mounted in the cutting head 104 which follows a predetermined cutting path by servomotors. The pivot axis of the cutting knife is the Z-axis which is perpendicular to the cutting surface of a three-dimensional coordinate system X, Y, Z of the controlling means for generating the cutting path of the knife. According to the predetermined controlled motion of the X-Y-carriage and the motion of the knife around the Z-axis, the cutting edge of the knife remains tangent to the cutting path represented by line "t" in FIG. 2. These movements are controlled by a controller 107.

The cutting table has evacuation means (not shown) in order to evacuate the cutting table 103 for holding the staple in a defined position by atmospheric pressure. The cutting surface of the cutting machine is penetrable by the cutting knife in well known manner.

Neither the servo-motors for driving the X-Y-carriage in X- and Y-direction and the cutting head around Z-axis nor the motor and power transmission for the reciprocating movement of the cutting knife are shown.

Figure 4:
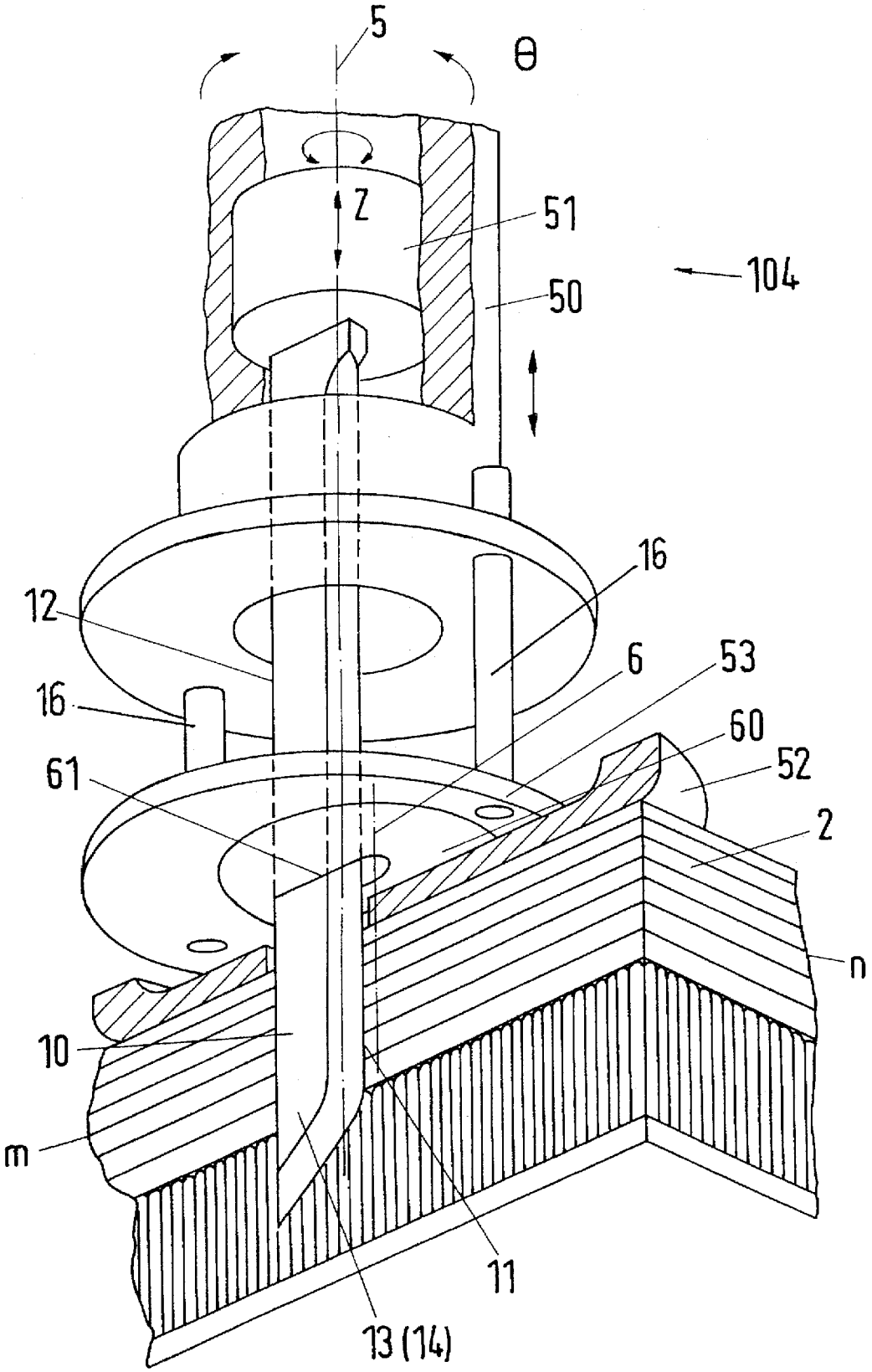
FIG. 4 shows an isometric view of a part of a cutting head of a cutting machine according to FIG. 1 having a pilot device according to the invention.

FIG. 4 illustrates a part of the cutting head 104 which comprises a shaft 50 housing a mount 51 which is reciprocally movable and guided within the shaft 50 along and freely rotatable about an axis 5 which is the Z-axis of the coordinate system. On the mount 51 a knife 10 is suspended having a cutting or leading edge 11, a trailing edge 12 and two flanks 13 and 14 between the leading and trailing edge.

A pressure foot 52 is rigidly, but adjustably connected to the shaft 50 for lying on the upper layer of the staple of the fabric sheet material. A socket 53 is rigidly connected to shaft 50 by posts 16 and disposed adjacent to the pressure foot. In the socket 53 a support 60 is freely rotatably mounted about a vertical axis 6 which is in front and adjacent to the cutting edge 11 of the cutting knife 10 and parallel at a predetermined distance to the Z-axis (5) of the coordinate system, thus the cutting edge is placed between the Z-axis and the vertical axis 6.

In the support 60 is a slot 61 eccentrically arranged relative to the vertical axis 6 and surrounding the cutting knife near the free end of the knife. The inner surfaces of the slot 61 act as a lateral operative glide bearing for the trailing edge 12 and the flanks 13 and 14 of the knife while the knife is in reciprocating movement; for example driven by a electromagnetic linear motor.

According to the arrangement of the just described knife 10 which moves up and down along the shaft 50, but is free to rotate independently within the shaft 50 around the vertical axis 5. As mentioned above, the curved paths are followed by rotating shaft 50 by means of θ-servomotor and drive (not shown) in accordance with the controller commands.

Lower support 60 can rotate around axis 6, which is placed in front of the leading edge 11 of the knife 10, at a determined distance from axis 5 (Z-axis).

Both axis 5 and 6 provide to the knife 10 a determined position with respect to the assembly, as it can not freely rotate around both axes simultaneously. Thus, if the assembly rotates around axis 5 by command of the controller, the knife 10 will also rotate around this axis; this is the case to follow a predetermined curved path commanded by the controller 107 in well known manner.

Under this normal condition, it means that without loads acting onto the flanks of the knife 10, socket 53 and support 60 will turn around axis 5, namely the Z-axis, simultaneously according to the preprogrammed cutting path as the knife 10 acts as a dog.

During the cutting operations, different pressures at both flanks 13 and 14 of the knife 10 will appear, then causing lateral loads and deformations as mentioned above. Due to the knife support conditions, the lateral loads that appear on the knife in the range of the cutting area are supported in the support 60 and cause a twisting of the support around the axis 6. This twisting is limited by the bending stiffness of the knife 10 between the support 60 and the upper end suspended to mount 51, see FIG. 5 which shows schematically a plan view of the different knife sections. Section 70 is a plan view of the knife 10 before loading. Sections 80 and 90 refer to a laterally loaded condition. Section 80 illustrates the knife section at the level of support 60 when the knife 10 has twisted under lateral loads together with support 60 around axis 6 which remains in its original position as axis 6 is stiffly joined to shaft 50. The section 90 is the suspended knife section at the upper end, connected to mount 51; the knife is twisted around the axis 5. The bending deformation "f" between sections 80 and 90 is related to the angle of twisting and both of them depend on the lateral loads and the knife bending stiffness.

In other words, due to the free pivotability of the mount 51 about the axis 5 with respect to the shaft 50 and of the support 60 about axis 6 with respect to the shaft 50, the knife 10 can twist in the region between the slot 61 and the mount 51 due to the loads on the flanks and due to the straining capability of the knife as the leading edge of the cutting knife 10 lags behind the advancing axis 6 seen in the feeding direction. The knife torque stiffness is of the same order as the knife bending stiffness but the torque moment due to the pressure loads is much less than the bending moment and therefore the strain to torsion is considered neglegible. That means that every knife section of the free end of the knife 10 will twist almost the same angle around the longitudinal axis of the knife until the forces acting on the flanks of the knife are equal.

Figure 3:
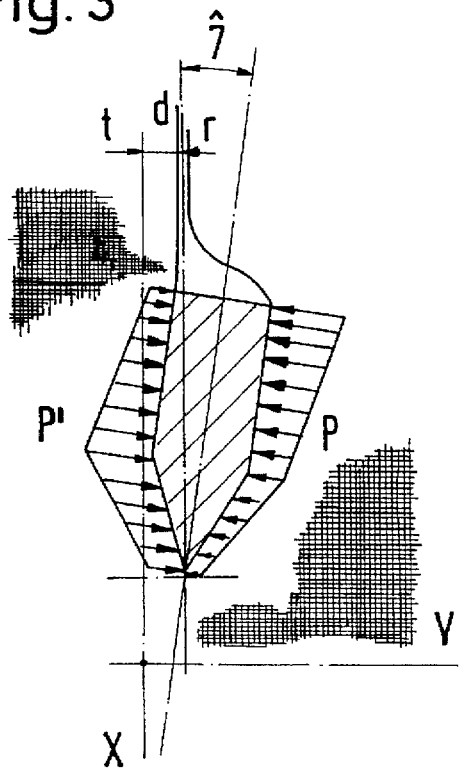
FIG. 3 shows an orthogonal section through the cutting knife according to FIG. 2 with balanced load distribution acting on the flanks of the knife.
Figure 5:
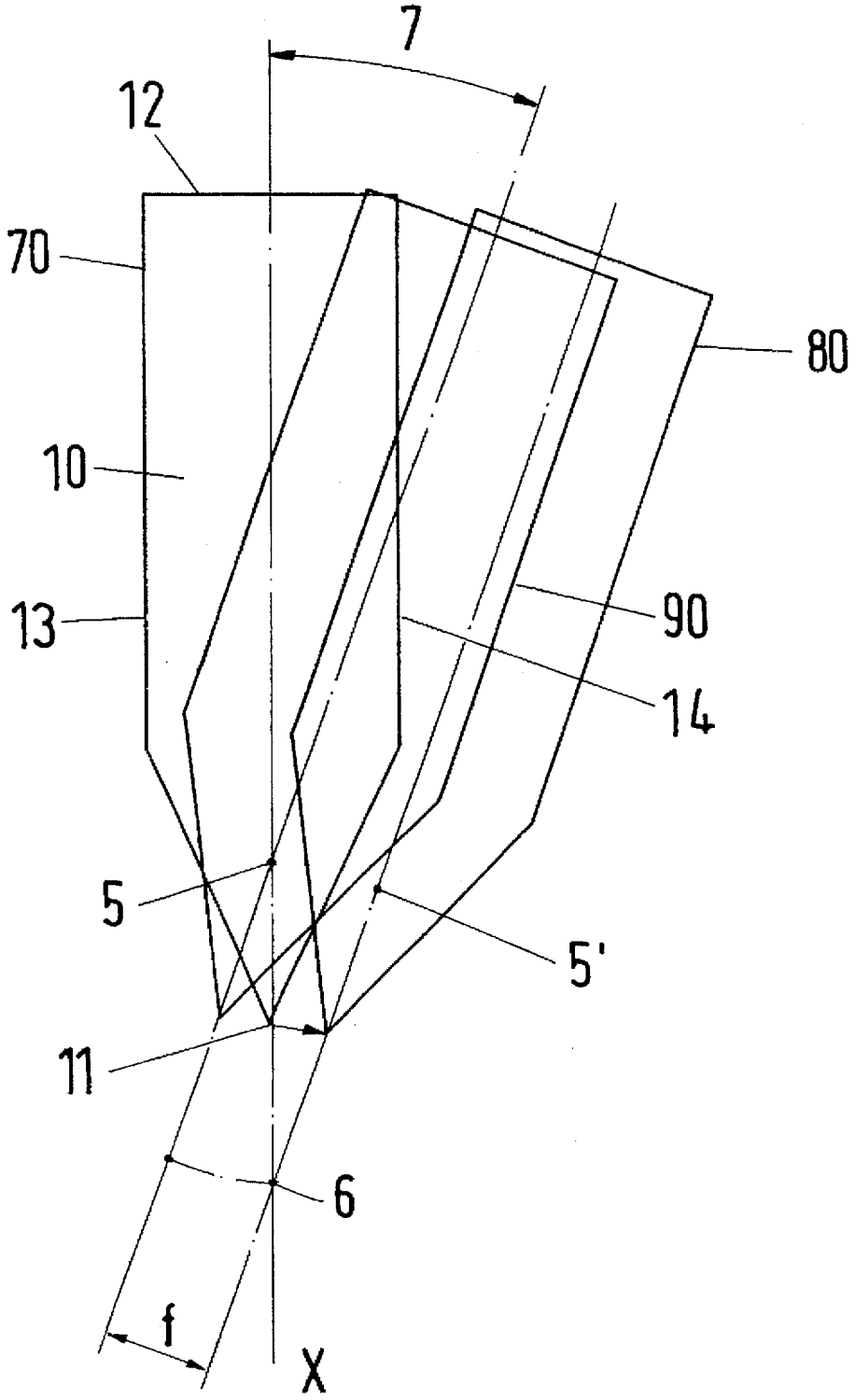
FIG. 5 shows the geometric relation of the knife of the cutting head according to the invention in different sectional orthogonal cuts due to the balance effect of the pilot device according to FIG. 4.

This self balancing effect is shown in FIGS. 3 and 5. When the cutting knife 10 is laterally unloaded, any of the orthogonal sections along the knife are congruent, as seen indicated by number 70 and the Z-axis (5) and axis 6, respectively intersecting perpendicularly the tangent to the predetermined cutting path; see FIG. 5.

While being in cutting condition along a curved cutting path, lateral loads appear to the flanks of the cutting knife and thus to the inner surfaces of the slot 61. Under the influence of the lateral loads, the knife will twist due to the free rotatability of the support 60 with respect to the cutting head 104 whereby rotation of the cutting head 104 about the Z-axis represents the actual tangent angle to the predetermined cutting path as is seen in FIG. 5 indicated by number 80. This twisting effect comes into an equilibrium state at that condition when the lateral loads are balanced by the torque stiffness of the cutting knife, which is slidably guided between the inner surfaces of the slot 61 of the support 60, and the interrelationship of the eccentrically arranged vertical axis 6 of the support 60 in relation to mount 51 guided by the shaft 50 which is rigidly associated with the cutting head 104.

Under this circumstance the vertical axis 6 remains in the same position while the intersection point of axis 5 moves to 5', section 80 of FIG. 5, however axis 5 remains at the same position in the suspended section of the cutting knife as is referenced by number 90 in FIG. 5. The cutting knife twists together with the suspension mount 51 around axis 5 at the same angle 7 as the support 60 twists around the axis 6 as shown in FIG. 5. The displacement "f" and the angle 7 twisted under influence of the lateral loads onto the flanks of the knife are geometrically related by the position of axis 5 and 6. The displacement "f" is a function of the load and the knife bending stiffness. This function can be optimized for instance by using spring means acting on the support 60.

Under these conditions the deviation "d" of the actual cutting path with respect to the predetermined theoretic cutting path will become a minimum. Thus the deviation of knife sections beneath the pressure foot 52 within the staple of layered sheet material would be minimized as well.

Figure 6:
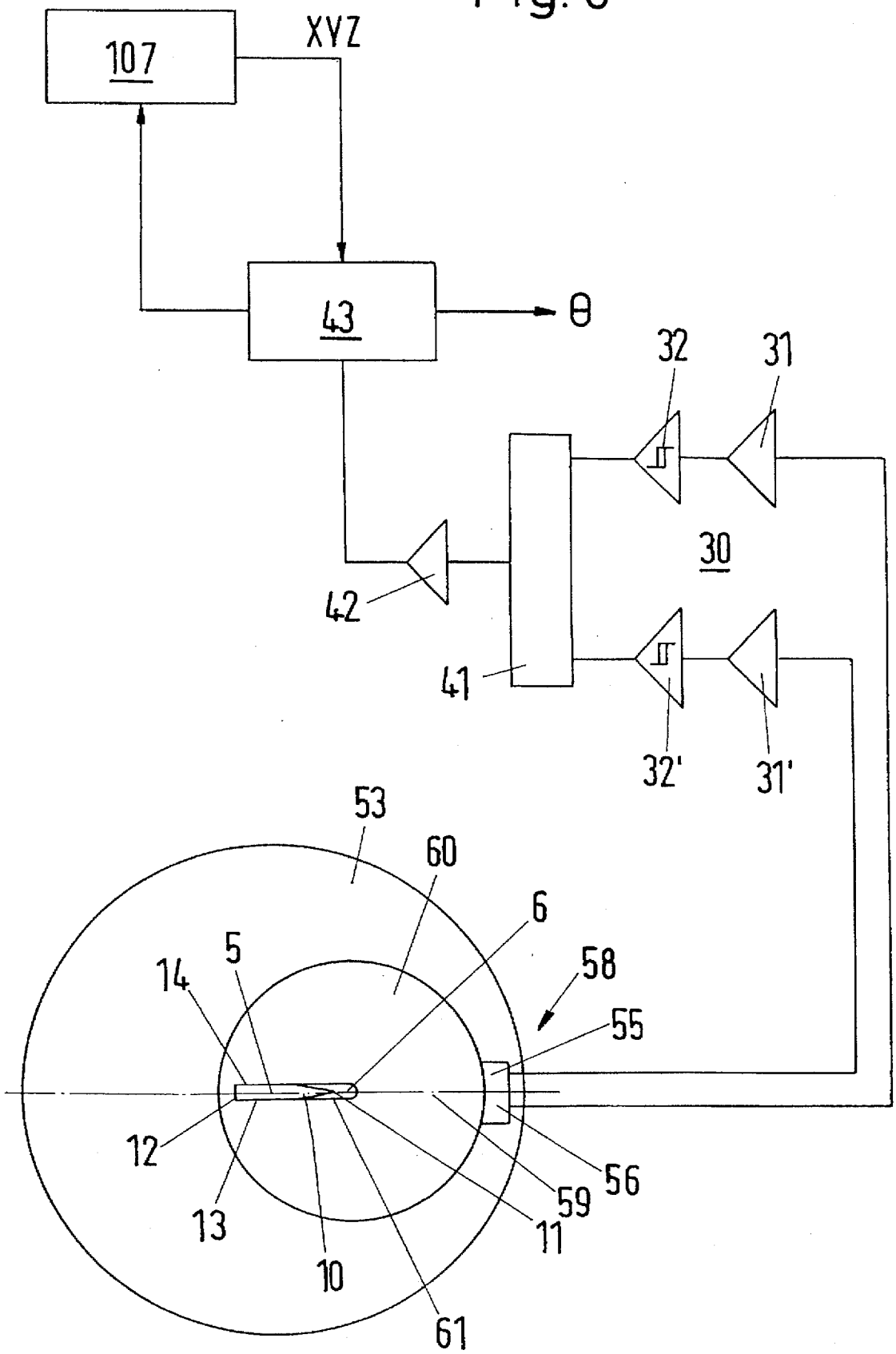
FIG. 6 illustrates a block diagram of the arrangement according to the invention for superimposing a correction angle to the predetermined orientation angle of the knife in relation to the cutting path.

In order to support this correction of displacement "f", further means are used as shown in FIG. 6 where sensor means 58 are arranged on the socket 53 symmetrical to a center line 59 which is rectangular to the axis 5 (Z-axis) and to the axis 6 and goes through these axes. Specifically, the sensor means 58 is a digital sensor means which includes two microswitches 55 and 56, where each microswitch is arranged symmetrically with respect to the center line 59 to detect the motion of the support 60 relative to the socket 53. The sensor means 58 are connected to a discriminator stage 30 comprising amplifier and pulsformer stages 31,31' and 32,32' in a two way fashion.

The output of the discriminator stage is connected to a processing stage 41 which is followed by a amplifier 42 and the controller 43 of the θ-servomotor (not shown). The controller 43 is connected to the main controller 107 of the cutting machine 100 and is receiving at least the X-,Y- and Z-data representing the predetermined cutting path. Further the controller 43 might be a provision for a feed back data channel for back transmission of processed data from the main-controller 107 of the cutting machine. This information can be used for automatic reduction of feed and/or stroke rate of the cutting knife in dependence on the processed correction angle of the controller 43 in order to prevent knife rupture and/or for automatic detecting of a knife rupture and interrupting the cutting process.

The signals provided by the processing stage 41 correspond to the quantity of the pivot angle between support 60 and socket 53 according to the bending of the knife 10 and/or its direction during the cutting process.

In the controller 43 these signals of the processing stage 41 are used for processing the signals according to the predetermined cutting path processed by the controller 107 representing the θ-information for the cutting head for correction of the final θ-position of the cutting head in known manner.

From the foregoing description it can be seen that the knife bending effect during the cutting operation of the sheet material can be reduced close to zero without need of a measurement of forces acting on the flanks of said knife since the correction signals are based on the detection of the knife twisting about its longitudinal axis only. Accordingly, the subsequent data processing is simple and is limited to a small range.

While the foregoing description and drawings represent the preferred embodiments of the present invention, it will be obvious to those skilled in the art that various changes and modifications may be made therein without departing from the true spirit and scope of the present invention.

What is claimed is:

1. In an automatically controlled cutting machine for cutting fabric sheet material spread out on a cutting table in multiple layers, wherein a cutting tool, which includes a cutting knife mounted to a cutting head, is controlled according to a three-dimensional coordinate system by means for moving the cutting tool along the X-and Y-axis and pivoting about the Z-axis for moving the knife tangently along a predetermined cutting path during cutting of the material, said cutting knife being mounted to said cutting head so as to be reciprocally movable along said Z-axis, said cutting tool further including guiding means for guiding the cutting knife and a pressure foot rigidly connected to the cutting head, the improvement comprising that:

said knife has a first end which is mounted in the cutting head so as to be freely rotatable around the Z-axis and a second end which includes a cutting edge for engaging the sheet material;

said guiding means is arranged adjacent to the second end of the knife and includes a socket rigidly connected to the cutting head and a support which is freely and rotatably mounted in said socket around a vertical axis, wherein the vertical axis is located adjacent to the cutting edge of said knife and spaced from said knife, and further wherein the vertical axis is parallel and spaced a predetermined distance from the Z-axis of the coordinate system;

said knife extends through said socket and through a slot in said support, said slot surrounding flanks of the knife and said slot is eccentrically positioned relative to said vertical axis and extends to a trailing edge of the knife; and said socket further includes a sensor means for detecting at least one of an instantaneous rotation angle and a rotation direction of the support relative to the socket for providing correcting signals for controlling the movement of the knife about the Z-axis to regulate the cutting of the material by the knife along the predetermined cutting path in response to one of the detected rotation angle and rotation direction.

2. The cutting machine according to claim 1, wherein the cutting head includes a shaft and said socket is rigidly connected to said shaft, and wherein said shaft, forms a housing in which a mount, to which the first end of the cutting knife is attached, is slidably disposed.

3. The cutting machine according to claim 1, wherein the support is provided in an area adjacent to the pressure foot.

4. The cutting machine according to claim 1, wherein the output of the sensor means is transmitted to a discriminator which is followed by a processing stage for transforming the sensor signals into control signals for the controller of the cutting machine.

5. The cutting machine according to claim 1, wherein the sensor means are digital sensor means arranged on the socket symmetrically to a center line which is perpendicular to the Z-axis and the vertical axis.

6. The cutting machine according to claim 1, wherein the sensor means comprises two microswitches each microswitch representing one direction of the motion of the support relative to the socket.

* * * * *